US008029326B2

(12) United States Patent
Rossman

(10) Patent No.: US 8,029,326 B2
(45) Date of Patent: Oct. 4, 2011

(54) ELECTRICAL CONNECTOR HAVING AN ELECTRICAL CONTACT WITH A CONTACT ARM

(75) Inventor: Jared Evan Rossman, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/510,865

(22) Filed: Jul. 28, 2009

(65) Prior Publication Data

US 2011/0028048 A1 Feb. 3, 2011

(51) Int. Cl.
*H01R 13/187* (2006.01)

(52) U.S. Cl. ..... 439/843

(58) Field of Classification Search ..... 439/843, 439/851, 733.1, 734, 739, 743
See application file for complete search history.

(56) References Cited

U.S. PATENT DOCUMENTS

| | | | | |
|---|---|---|---|---|
| 6,520,998 | B1 * | 2/2003 | Scholler et al. | 439/851 |
| 6,899,571 | B1 * | 5/2005 | Koch et al. | 439/843 |
| 7,048,596 | B2 * | 5/2006 | Swearingen et al. | 439/843 |
| 7,387,548 | B2 * | 6/2008 | Takehara et al. | 439/843 |
| 2002/0049006 | A1 * | 4/2002 | Zhao et al. | 439/843 |
| 2009/0029605 | A1 * | 1/2009 | Matsumoto et al. | 439/843 |

FOREIGN PATENT DOCUMENTS

| | | |
|---|---|---|
| EP | 0 283 768 | 9/1988 |
| EP | 0 442 639 | 8/1991 |
| EP | 0 518 568 | 12/1992 |
| GB | 2 065 993 | 7/1981 |

OTHER PUBLICATIONS

Customer Information Sheet—Revisions, Contact, Socket, Size 1/4 with #4 AWG Crimp Barrel, Single CRN Rapid Lock, Tyco Part No. 6648434-1, Drawn: Aug. 30, 2005, Tyco Electronics Corporation, Menlo Park, CA, (1) page.

* cited by examiner

*Primary Examiner* — Chandrika Prasad

(57) ABSTRACT

An electrical contact includes an at least partially cylindrical body having a terminating segment and an end segment. A contact arm extends from the terminating segment to the end segment. The contact arm includes a contact tip that is configured to engage a mating contact to electrically connect the body to the mating contact. The contact arm defines a portion of a circumference of the body. The contact arm extends from the terminating segment and the end segment at corresponding ends of the contact arm. The contact arm includes an intermediate point that is located between the ends and that is offset from at least one of the ends along the circumference of the body.

20 Claims, 5 Drawing Sheets

ELECTRICAL CONNECTOR HAVING AN ELECTRICAL CONTACT WITH A CONTACT ARM

BACKGROUND OF THE INVENTION

The subject matter herein relates generally to electrical connectors, and more particularly, to electrical connectors having electrical contacts with contact arms.

Electrical connectors use a wide variety of electrical contacts to electrically connect electrical components together. Some known electrical contacts include a cylindrical body that defines a socket for receiving a pin or plug of a mating contact therein. The body includes a plurality of contact arms that engage the mating contact to establish an electrical connection between the body and the mating contact. For example, the contact arms include mating interfaces that extend radially inward into the socket. As the mating contact is received within the socket, the mating contact engages and deflects the mating interfaces of the contact arms radially outward. Resistance to the deflection by the mating contact facilitates establishing a reliable engagement and electrical connection between the contact arms and the mating contact. However, too high of a resistance may require an undesirably high insertion force to insert the mating contact into the socket.

The design of the contact arms of some known electrical contacts are not without disadvantages. For example, the contact arms of some known electrical contacts grow in length when deflected radially outward via the engagement with the mating contact. The resistance of the contact arms to such growth may increase the insertion force above desired levels. Moreover, a limited amount of space along the length of the body of the electrical contact results in some contact arms having a reduced length. The reduced length may provide the contact arms with a moment of inertia that requires an undesirably high insertion force to deflect the contact arms and thereby fully insert the mating contact into the socket. Furthermore, some known electrical contacts are two-piece contacts that include a body and an insert that is held within a cavity of the body. The insert includes the contact arms. The body of at least some known two-piece electrical contacts is fabricated using a screw machine process, which may be costly and/or may waste material. Moreover, assembly of the insert with the body may be difficult and/or time-consuming, which may increase a cost and/or manufacturing time of the electrical contact.

BRIEF DESCRIPTION OF THE INVENTION

In one embodiment, an electrical contact includes an at least partially cylindrical body having a terminating segment and an end segment. A contact arm extends from the terminating segment to the end segment. The contact arm includes a contact tip that is configured to engage a mating contact to electrically connect the body to the mating contact. The contact arm defines a portion of a circumference of the body. The contact arm extends from the terminating segment and the end segment at corresponding ends of the contact arm. The contact arm includes an intermediate point that is located between the ends and that is offset from at least one of the ends along the circumference of the body.

In another embodiment, an electrical connector includes a housing having a mating interface and an interior chamber, and an electrical contact held at least partially within the interior chamber of the housing. The electrical contact includes an at least partially cylindrical body including a terminating segment and an end segment. Contact arms extend from the terminating segment to the end segment. The contact arms include contact tips that are configured to engage a mating contact to electrically connect the body to the mating contact. The contact arms define a portion of a circumference of the body and are spaced apart from one another about the circumference. The contact arms extend from the terminating segment and the end segment at corresponding ends of the contact arms. The contact arms include intermediate points that are located between the ends and that are offset from the ends along the circumference of the body.

DETAILED DESCRIPTION OF THE INVENTION

Figure 1:
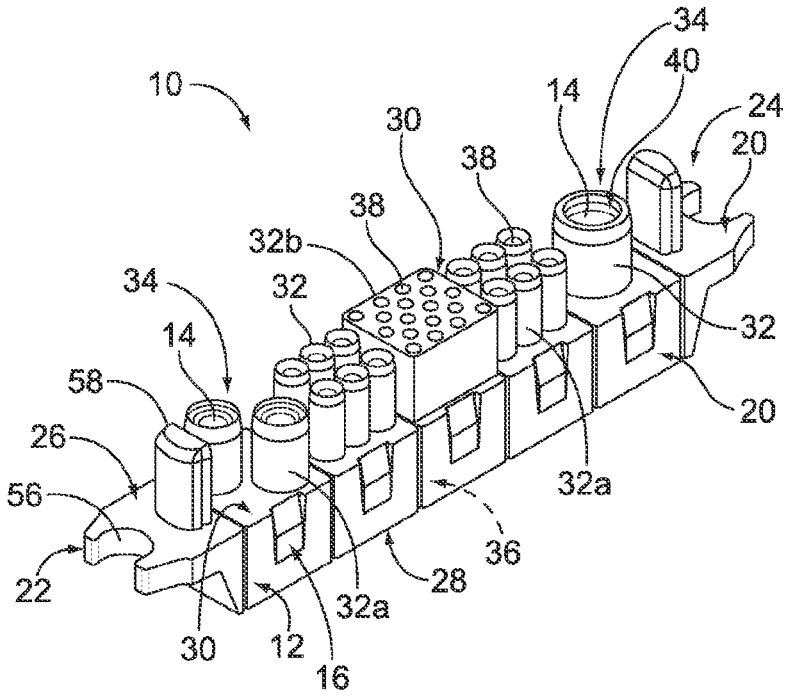
FIG. 1 is a perspective view of an exemplary embodiment of an electrical connector.

FIG. 1 is a perspective view of an exemplary embodiment of an electrical connector 10. The electrical connector 10 includes a housing 12 that holds a plurality of electrical contacts 14. Only some of the electrical contacts 14 are visible in FIG. 1. The electrical contacts 14 held by the housing 12 may include signal contacts, ground contacts, and/or power contacts. More specifically, each electrical contact 14 that is held by the housing 12 may transmit electrical data signals, electrical ground, or electrical power. The electrical connector 10 may be used, for example, as a drawer connector for network servers (not shown) and/or the like. However, the subject matter described and/or illustrated herein is not limited to drawer connectors. Rather, the subject matter described and/or illustrated herein may be used as, and/or with, any type of electrical connector for electrically connecting any electrical components together.

The housing 12 includes a base 20 that extends a length from an end 22 to an opposite end 24. The housing base 20 includes a mating side 26 that extends from the end 22 to the end 24, and a terminating side 28 that extends from the end 22 to the end 24. In the exemplary embodiment, the terminating side 28 is opposite the mating side 26. Alternatively, the mating side 26 and the terminating side 28 intersect. The mating side 26 defines a portion of a mating interface 30 at which the electrical connector 10 is configured to be mated with a mating connector (not shown). When mated with the mating connector, each of the electrical contacts 14 of the electrical connector 10 is engaged with, and thereby electrically connected to, one or more corresponding electrical contacts (not shown) of the mating connector. An electrical connection between the electrical connector 10 and the mating connector can thereby be established by mating the electrical connector 10 and the mating connector together at the mating interface 30.

Figure 2:
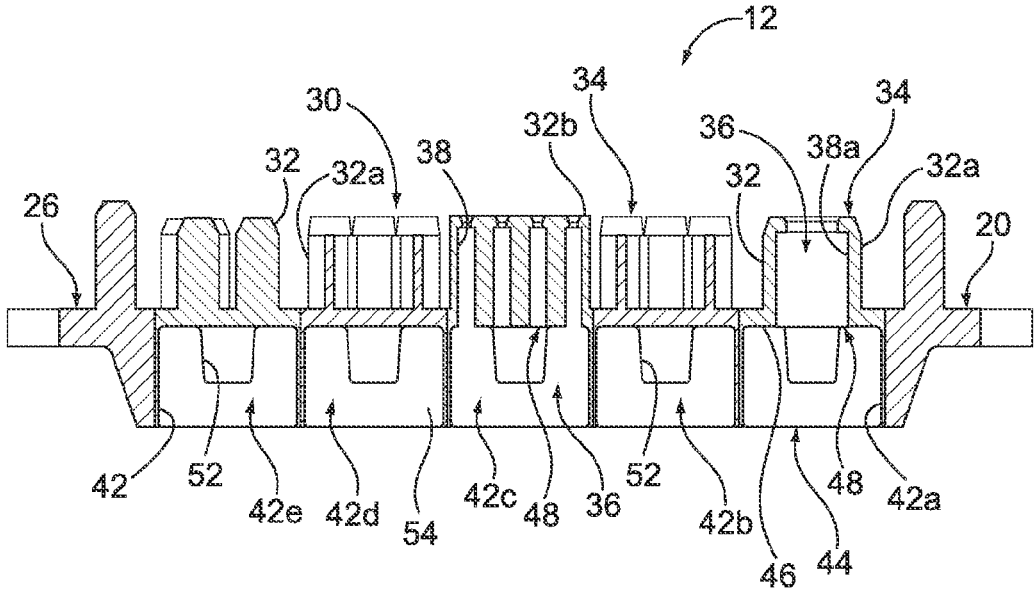
FIG. 2 is a cross-sectional of an exemplary embodiment of a housing of the electrical connector shown in FIG. 1.

FIG. 2 is a cross-sectional view of an exemplary embodiment of the housing 12. Referring now to FIGS. 1 and 2, in addition to the mating side 26 of the housing base 20, in the exemplary embodiment the mating interface 30 is defined by a plurality of contact extensions 32 that extend outwardly from the mating side 26 of the housing base 20. Each contact extension 32 extends a length from the mating side 26 of the housing base 20 to a free end 34. The housing 12 includes an interior chamber 36 within which the electrical contacts 14 (FIGS. 1, 6, 7, and 9) are held. Each contact extension 32 includes one or more mating cavities 38 that extend through the length of the contact extension 32. The mating cavities 38 define a portion of the interior chamber 36 of the housing 12. As will be described below, each mating cavity 38 holds a mating segment 40 (not shown in FIG. 2) of one or more of the electrical contacts 14 therein.

In the exemplary embodiment, the contact extensions 32 include a plurality of contact barrels 32*a* and a contact block 32*b*. Each contact barrel 32*a* includes a cylindrically shaped body that includes a single one of the mating cavities 38 extending therethrough. The contact block 32*b* includes a rectangular shaped body that includes a plurality of the mating cavities 38 extending therethrough. Although sixteen are shown, the housing 12 may include any number of the contact extensions 32, including any number of the contact barrels 32*a* and any number of the contact blocks 32*b*. Moreover, each contact extension 32 may include any number of the mating cavities 38 for holding any number of the electrical contacts 14. In addition or alternative to the cylindrical and rectangular shapes shown herein, each contact extension 32 may include any other shape.

As best seen in FIG. 2, the terminating side 28 of the housing base 20 includes a plurality of mounting cavities 42 extending therein. The mounting cavities 42 define a portion of the interior chamber 36 of the housing 12. Each mounting cavity 42 extends into the housing base 20 from an open end 44 to a bottom 46. Each mounting cavity 42 is aligned along the length of the housing base 20 with one or more corresponding ones of the contact extensions 32. Accordingly, each mounting cavity 42 is aligned with one or more corresponding mating cavities 38 of the contact extensions 32. One or more openings 48 extend through the bottom 46 of each of the mounting cavities 42 such that each mating cavity 38 fluidly communicates with the corresponding mounting cavity 42 with which the mating cavity 38 is aligned. As will be described below, each mounting cavity 42 holds a dielectric insert 16 (FIGS. 1, 3-5, and 9) therein. The dielectric inserts 16 hold terminating segments 50 (FIGS. 6 and 9) of one or more of the electrical contacts 14 such that the mating segment 40 (FIGS. 1, 6, 7, and 9) of the electrical contact 14 extends within the corresponding mating cavity 38. Although five are shown, the terminating side 28 of the housing base 20 may include any number of the mounting cavities 42, each of which may hold any number of the dielectric inserts 16 and any number of the electrical contacts 14. Although shown as including a rectangular shape, each mounting cavity 42 may additionally or alternatively include any other shape.

The housing base 20 includes a plurality of optional latch openings 52 for latching the dielectric inserts 16 within the mounting cavities 42. The latch openings 52 extend through walls 54 of the housing base 20 that define the mounting cavities 42. In addition or alternatively to the latch openings 52, the housing base 20 may include any other type of latch element for latching the dielectric inserts 16 within the mounting cavities 42, such as, but not limited to, extensions, arms, shoulders, tabs, a snap-fit, an interference (or clearance) fit, other types of fasteners, and/or the like. The housing base 20 may include any number of the latch openings 52.

Referring again to FIG. 1, the housing base 20 optionally includes one or more mounting features 56 for mounting the housing 12 on a structure, such as, but not limited to, a panel, a housing, a wall, a rack, and/or the like. Although two are shown, the housing base 20 may include any number of the mounting features 56. In the exemplary embodiment, each mounting feature 56 is located at a corresponding one of the ends 22 and 24 of the housing base 20. However, the housing base 20 may additionally or alternatively include one or more mounting features 56 at any other location along the length of the housing base 20 than the ends 22 and/or 24. Moreover, although shown as openings, each mounting feature 56 may additionally or alternatively include any other structure, such as, but not limited to, extensions, clips, latches, arms, shoulders, tabs, a snap-fit, an interference (or clearance) fit, other types of fasteners, and/or the like.

Optionally, the housing base 20 includes one or more alignment extensions 58 for aligning the housing 12 with the mating connector during mating of the electrical connector 10 with the mating connector. In the exemplary embodiment, each of the alignment extensions 58 extends outwardly from the mating side 26 of the housing base 20 adjacent a corresponding one of the ends 22 and 24 of the housing base 20. The alignment extensions 58 are each received within a corresponding alignment opening (not shown) of the mating connector during mating therewith. In addition or alternative to the alignment extensions 58, the housing base 20 may include one or more alignment openings (not shown) that receives an alignment extension (not shown) of the mating connector therein. The housing base 20 may include any number of the alignment extensions 58. In the exemplary embodiment, the housing base 20 includes two alignment extensions 58. Each of the alignment extensions 58 may alternatively be located at any other location along the length of the housing base 20 than adjacent the ends 22 and/or 24.

Figure 3:
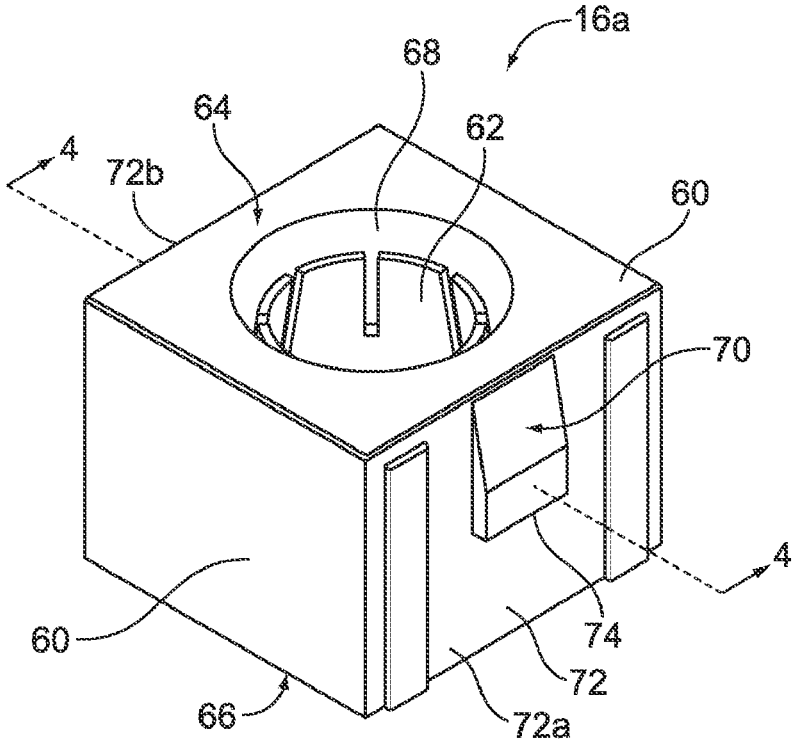
FIG. 3 is a perspective view of an exemplary embodiment of a dielectric insert of the electrical connector shown in FIG. 1.
Figure 4:
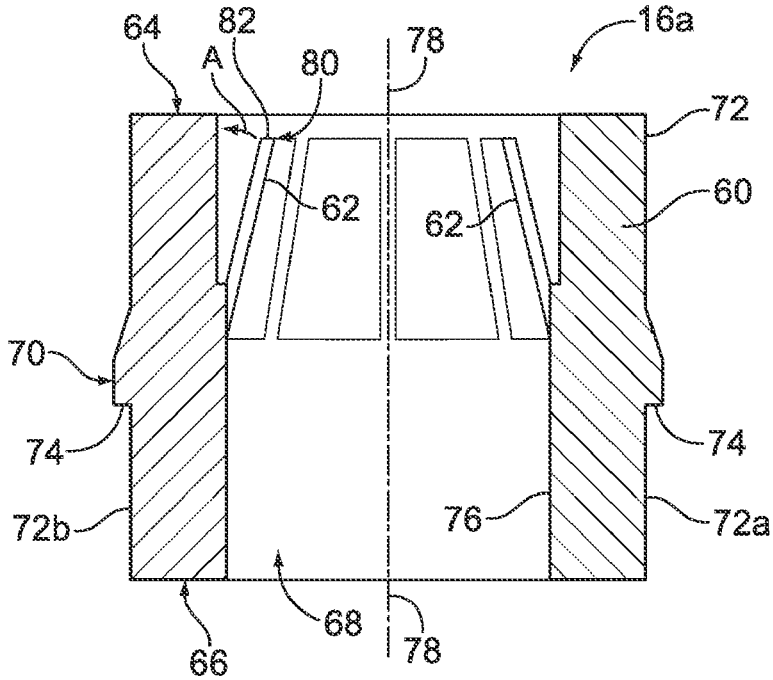
FIG. 4 is a cross-sectional view of the dielectric insert shown in FIG. 3 taken along line 4-4 of FIG. 3.
Figure 9:
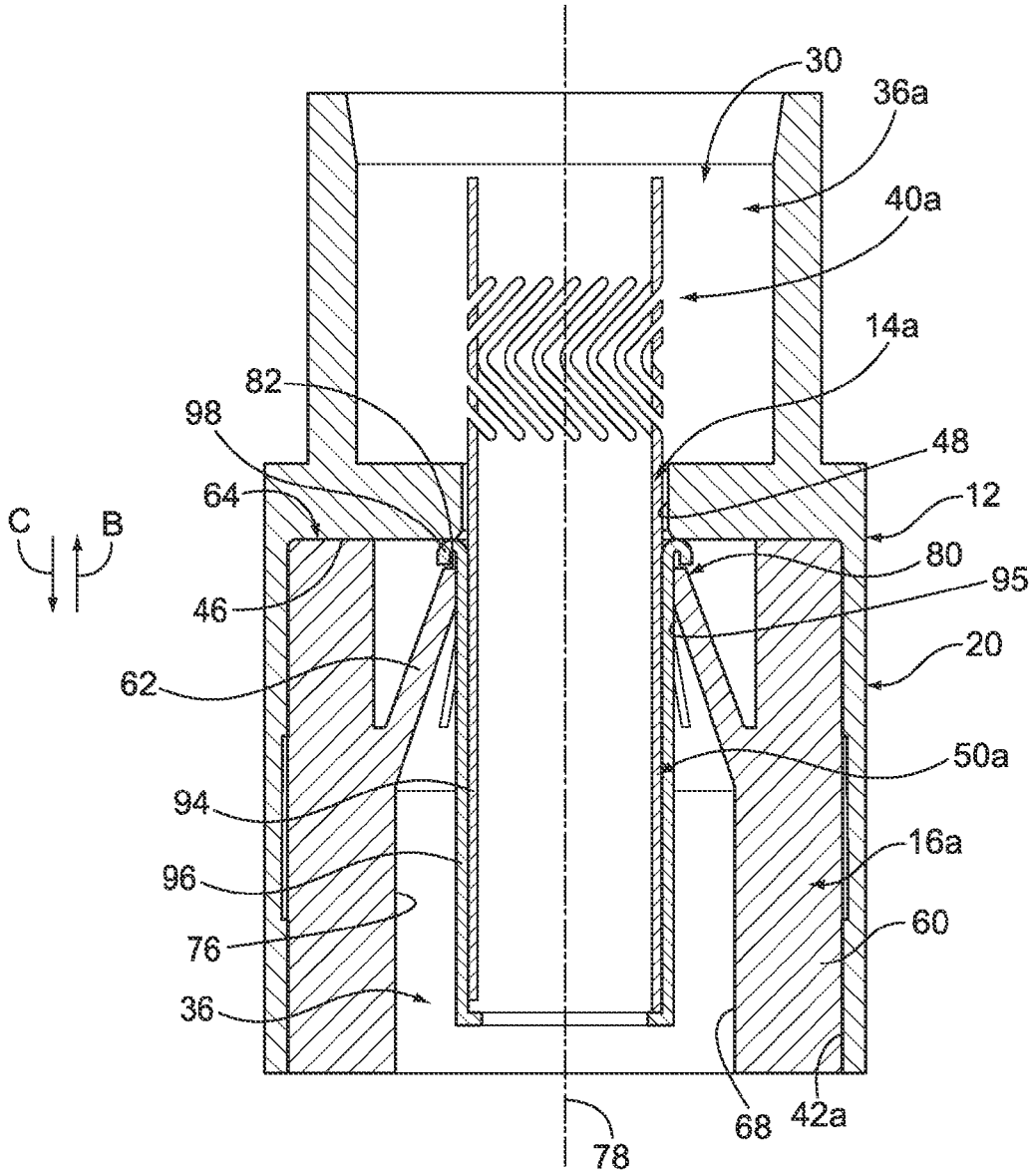
FIG. 9 is a cross-sectional view of a portion of the electrical connector shown in FIG. 1 illustrating the dielectric insert shown in FIG. 3 retaining the electrical contact shown in FIGS. 6 and 7 within the housing shown in FIG. 2.

FIG. 3 is a perspective view of an exemplary embodiment of one of the dielectric inserts 16*a*. FIG. 4 is a cross-sectional view of the dielectric insert 16*a* taken along line 4-4 of FIG. 3. Referring now to FIGS. 3 and 4, the dielectric insert 16*a* is configured to be received within a corresponding one of the mounting cavities 42*a* (FIGS. 2 and 9). The dielectric insert 16*a* includes a base 60 and one or more resilient fingers 62 extending from the base 60. The base 60 extends a length from an end 64 to an opposite end 66. A contact channel 68 extends through the length of the base 60. Specifically, the contact channel 68 extends through the ends 64 and 66 and completely through the base 60 therebetween. The contact channel 68 is configured to hold the terminating segment 50 (FIGS. 6 and 9) of a corresponding one of the electrical contacts 14 (FIGS. 1, 6, 7, and 9) therein. Although shown as cylindrical, the contact channel 68 may additionally or alternatively include any other shape.

The base 60 of the dielectric insert 16*a* is optionally shaped complementary to the mounting cavity 42*a* for reception therein. In the exemplary embodiment, the base 60 of the dielectric insert 16*a* includes a rectangular shape that is complementary to the rectangular shape of the mounting cavity 42*a*. However, the base 60 of the dielectric insert 16*a* may additionally or alternatively include any other shape for reception within a mounting cavity 42 having any shape. The base 60 includes one or more optional latch tabs 70 that cooperate with the latch openings 52 (FIG. 2) of the housing base 20 (FIGS. 1, 2, and 9) to latch the dielectric insert 16*a* within the mounting cavity 42*a*. Each latch tab 70 extends outwardly from a side 72 of the base 60 of the dielectric insert 16*a* and includes a shoulder 74. As the dielectric insert 16*a* is loaded into the mounting cavity 42*a*, the latch tabs 70 are each received within a corresponding one of the latch openings 52. The shoulders 74 engage surfaces of the wall 54 (FIG. 2) of the housing base 20 that define the latch openings 52 to latch the dielectric insert 16*a* within the mounting cavity 42*a*. In addition or alternatively to the latch tabs 70, the base 60 of the dielectric insert may include any other type of latch element for latching the dielectric insert 16*a* within the mounting cavity 42*a*, such as, but not limited to, openings and/or the like. In some embodiments, and in addition or alternative to the latch tabs 70, the dielectric insert 16*a* is held within the mounting cavity 42*a* via an interference, or clearance, fit between the base 60 and the housing 12. The base 60 of the dielectric insert 16*a* may include any number of the latch tabs 70. In the exemplary embodiment, the base 60 of the dielectric insert 16*a* includes two latch tabs 70 (only one is visible in FIG. 1) located on opposite sides 72*a* and 72*b* of the base 60. In addition or alternative to the sides 72*a* and 72*b*, the base 60 may include latch tabs 70 at any other locations thereon.

Referring now to FIG. 4, the base 60 of the dielectric insert 16*a* includes an interior surface 76 that defines the contact channel 68. The contact channel 68 extends a length through the base 60 along a central longitudinal axis 78. Each resilient finger 62 extends outwardly from the interior surface 76 of the base 60 into the contact channel 68. In other words, the resilient fingers 62 extend outwardly from the interior surface 76 of the base 60 radially inward relative to the central longitudinal axis 78 and along the length of the contact channel 68 toward the end 64 of the base 60. Each resilient finger 62 extends a length from the interior surface 76 of the base 60 to a tip 80. Each tip 80 includes an end surface 82. The tips 80 of the resilient fingers 62 are configured to engage the terminating segment 50 (FIGS. 6 and 9) of a corresponding one of the electrical contacts 14 (FIGS. 1, 6, 7, and 9) to hold the electrical contact 14 within the contact channel 68. For example, the end surface 82 of each tip 80 engages the corresponding electrical contact 14.

The tips 80 of the resilient fingers 62 are biased to a locked position, which is shown in FIG. 4. In other words, the tips 80 are in the locked position when the resilient fingers 62 are in the natural, or undeformed, state thereof. Each tip 80 is movable from the locked position, and against the bias, radially outward relative to the central longitudinal axis 78 and toward the interior surface 76 of the base 60. Movement of the tips 80 radially outward relative to the central longitudinal axis 78 and toward the interior surface 76 of the base 60 is indicated in FIG. 4 by the arc A. As will be described below, in the locked position, the tips 80 of the resilient fingers 62 are engaged with the corresponding electrical contact 14.

Referring again to FIG. 3, the resilient fingers 62 are spaced apart from one another about a periphery of the contact channel 68. In other words, the resilient fingers 62 are spaced apart from each other about the interior surface 76 of the base 60 of the dielectric insert 16*a*. In the exemplary embodiment, each resilient finger 62 includes a rectangular shape; however, each resilient finger 62 may additionally or alternatively include any other shape. Moreover, although the end surfaces 82 of the tips 80 are shown herein as being approximately planar, the end surface 82 of each tip 80 may additionally or alternatively include any other shape. For example, in some alternative embodiments, the end surface 82 of one or more of the tips 80 includes a curved shape, a v-shape, and/or the like. In some embodiments, the end surface 82 or another portion of the one or more of the tips 80 may include a shape that is complementary to the shape of the portion of the electrical contact 14 that the tip 80 engages. Any number of the resilient fingers 62 may extend within the contact channel 68 of the dielectric insert 16*a*. In the exemplary embodiment, the dielectric insert 16*a* includes eight resilient fingers 62, only six of which are visible in FIG. 3.

Figure 5:
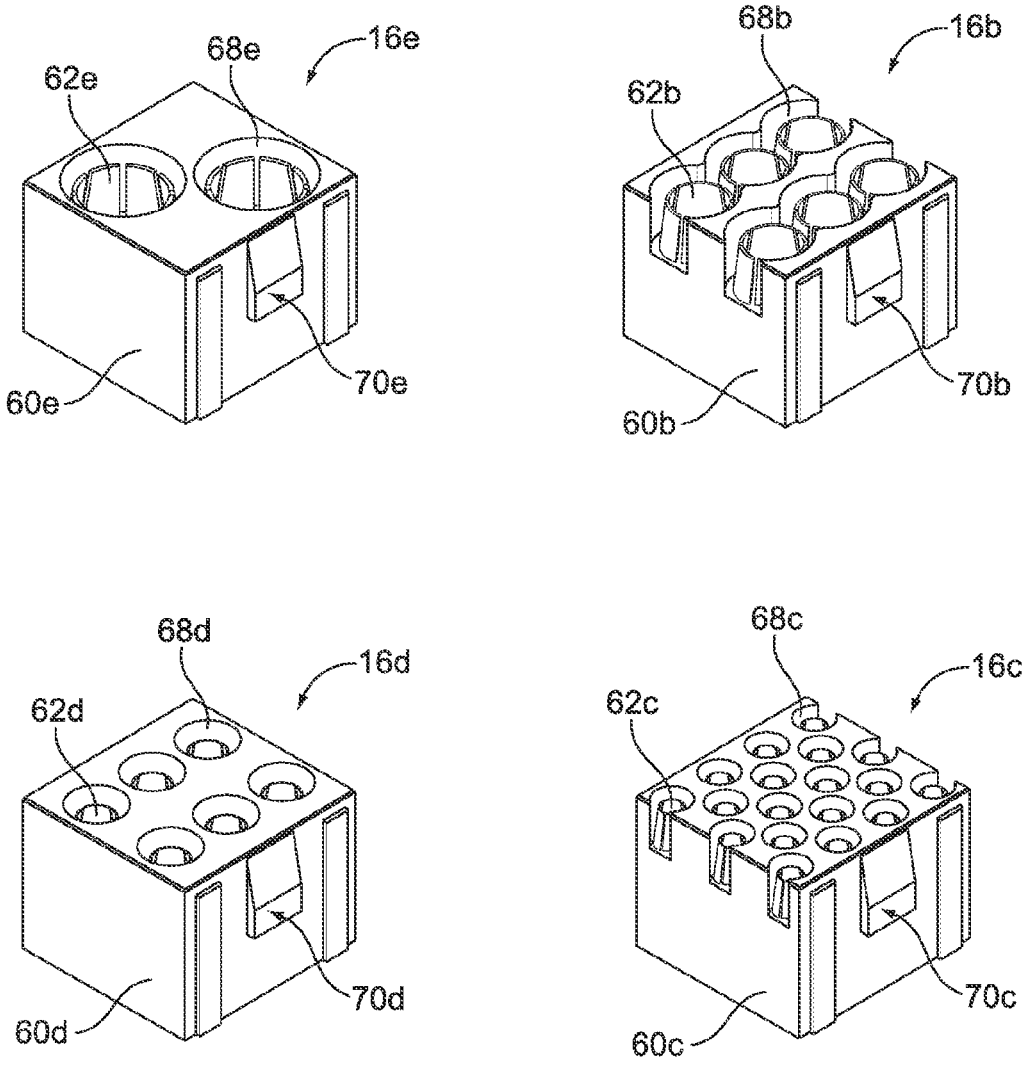
FIG. 5 is a perspective view of a plurality of exemplary embodiments of other dielectric inserts of the electrical connector 10 shown in FIG. 1.

Although shown and described as having only a single contact channel 68 for holding a single electrical contact 14, the dielectric insert 16*a* may include any number of contact channels 68 for holding any number of the electrical contacts 14. For example, FIG. 5 is a perspective view of a plurality of exemplary embodiments of other dielectric inserts 16*b*, 16*c*, 16*d*, and 16*e* of the electrical connector 10 (FIGS. 1 and 9). The dielectric inserts 16*b*, 16*c*, 16*d*, and 16*e* are configured to be received within mounting cavities 42*b*, 42*c*, 42*d*, and 42*e* (FIG. 2), respectively, of the housing 12 of the electrical connector 10. Each dielectric insert 16*b*, 16*c*, 16*d*, and 16*e* includes a plurality of respective contact channels 68*b*, 68*c*, 68*d*, and 68*e*. For example, the dielectric inserts 16*b* and 16*d* each include a respective base 60*b* and 60*d* having six respective contact channels 68*b* and 68*d* extending through the length thereof. Each contact channel 68*b* and 68*d* holds a corresponding one of the electrical contacts 14 (FIGS. 1, 6, 7, and 9) therein. Four resilient fingers 62*b* and 62*d* extend within each of the contact channels 68*b* and 68*d*, respectively, for holding the corresponding electrical contact 14 therein. Similar to the dielectric insert 16*a* (FIGS. 3, 4, and 9), the bases 60*b* and 60*d* of the respective dielectric inserts 16*b* and 16*d* include one or more optional latching tabs 70*b* and 70*d*, respectively, for latching the dielectric inserts 16*b* and 16*d* within the respective mounting cavities 42*b* and 42*d*.

The dielectric insert 16*c* includes a base 60*c* having eighteen contact channels 68*c* extending through the length thereof. Each contact channel 68*c* of the dielectric insert 16*c* holds a corresponding one of the electrical contacts 14 therein. Two resilient fingers 62*c* extend within each of the contact channels 68*c* for holding the corresponding electrical contact 14 therein. The base 60*c* of the dielectric insert 16*c* includes one or more optional latching tabs 70*c* for latching the dielectric insert 16*c* within the mounting cavity 42*c*.

Two contact channels 68*e* extend through the length of the base 60*e* of the dielectric insert 16*e*. The contact channels 68*e* of the dielectric insert 16*e* each hold a corresponding one of the electrical contacts 14 therein. Each contact channel 68*e* includes eight resilient fingers 62*e* for holding the corresponding electrical contact 14 therein. One or more optional latching tabs 70*e* are provided on the dielectric insert 16*e* for latching the dielectric insert 16*e* within the mounting cavity 42*e*.

Figure 6:
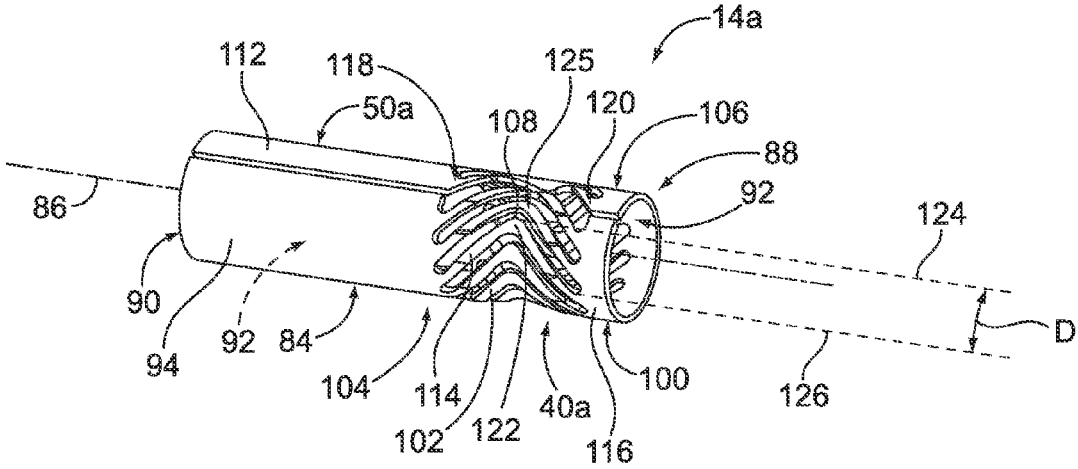
FIG. 6 is a perspective view of an exemplary embodiment of an electrical contact of the electrical connector shown in FIG. 1.
Figure 7:
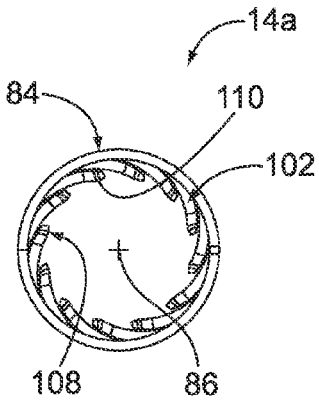
FIG. 7 is an elevational view of the electrical contact shown in FIG. 6.

FIG. 6 is a perspective view of an exemplary embodiment of an electrical contact 14*a* of the electrical connector 10 (FIGS. 1 and 9). The electrical contact 14*a* includes an at least partially cylindrical body 84 extending a length along a central longitudinal axis 86 from an end 88 to an end 90. In the exemplary embodiment, a passageway 92 extends through the length of the body 84. The electrical contact 14*a* includes a mating segment 40*a* and a terminating segment 50*a*. In the exemplary embodiment, the mating and terminating segments 40*a* and 50*a*, respectively, include the ends 88 and 90, respectively. Alternatively, the mating segment 40*a* and/or the terminating segment 50*a* are located along other portions of the electrical contact 14*a* such that the mating segment 40*a* and/or the terminating segment 50*a* do not include the respective ends 88 and/or 90, respectively.

In the exemplary embodiment, the terminating segment 50*a* of the electrical contact 14*a* includes an inner shell 94 and a sleeve 96 (FIG. 9) that extends at least partially around the inner shell 94. The sleeve 96 includes a shoulder 98 (FIG. 9). In some alternative embodiments, the terminating segment 50*a* of the electrical contact 14*a* does not include the sleeve 96. In such embodiments wherein the terminating segment 50*a* does not include the sleeve 96, the inner shell 94 optionally includes a shoulder (not shown), which is optionally formed integrally therewith. In the exemplary embodiment, the inner shell 94 of the terminating segment 50*a* is configured to receive an electrical conductor (not shown), for example an electrical conductor of an electrical cable (not shown) and/or an electrical wire (not shown), within the passageway 92 through the end 90 of the body 84. The inner shell 94 is crimped about the electrical conductor to mechanically connect the electrical conductor to the terminating segment 50*a* as well as establish an electrical connection therebetween. The terminating segment 50*a* is thereby configured to terminate the electrical cable and/or electrical wire in the exemplary embodiment. Alternatively, the terminating segment 50*a* includes any other type of contact structure, such as, but not limited to, a surface mount structure, a press-fit structure, a pin, and/or the like, for example, for electrically connecting the terminating segment 50*a* to a circuit board (not shown).

In the exemplary embodiment, the mating segment 40*a* of the electrical contact 14*a* is a socket that is configured to receive a portion of the corresponding electrical contact (not shown) of the mating connector (not shown). The corresponding electrical contact of the mating connector may be referred to herein as a "mating contact". The mating segment 40*a* includes an end segment 100 and, in the exemplary embodiment, a plurality of contact arms 102 that extend from the end segment 100 to the terminating segment 50*a*. The body 84 may include any number of the contact arms 102, including only a single contact arm 102. Specifically, the terminating segment 50*a* extends a length from the end 90 to an end 104, while the end segment 100 extends a length from the end 88 to an end 106. The contact arms 102 extend from the end 104 of the terminating segment 50*a* to the end 106 of the end segment 100. Each contact arm 102 includes a contact tip 108 that engages the corresponding electrical contact of the mating connector when the corresponding electrical contact of the mating connector is received within the passageway 92 of the body 84 through the end 88. Specifically, and referring now to FIG. 7, each contact tip 108 of the contact arms 102 includes a radially inner surface 110 (relative to the central longitudinal axis 86) that engages the corresponding electrical contact of the mating connector to establish an electrical connection between the corresponding electrical contact of the mating connector and the body 84 of the electrical contact 14*a*.

Referring again to FIG. 6, the body 84 of the electrical contact 14*a* includes a circumference that is defined by a radially outer surface 112 (relative to the central longitudinal axis 86) of the terminating segment 50*a*, radially outer surfaces 114 of the contact arms 102, and a radially outer surface 116 of the end segment 100. The contact arms 102 are spaced apart from one another about the circumference of the body 84. Each contact arm 102 is optionally nested with one or more adjacent contact arms 102. Each contact arm 102 extends a length from the terminating segment 50*a* to the end segment 100. Specifically, each contact arm 102 extends a length from an end 118 to an end 120. The ends 118 of the contact arms 102 extend from the end 104 of the terminating segment 50*a*, while the ends 120 of the contact arms 102 extend from the end 106 of the end segment 100.

Each contact arm 102 includes one or more intermediate points 122 that are located along the length thereof between the ends 118 and 120. The intermediate point 122 is offset from the end 118 and/or the end 120 along the circumference of the body 84. Accordingly, the intermediate point 122 is located at a different circumferential position on the body 84 than the ends 118 and/or 120. Although the ends 118 and 120 of each contact arm 102 are shown herein as having the same circumferential position, alternatively the ends 118 and 120 of one or more of the contact arms 102 have different circumferential positions. The offset is indicated by the angular distance D between the axes 124 and 126 that extend through the intermediate point 122 and the ends 118 and 120, respectively. In other words, each contact arm 102 extends along a non-linear path about the circumference of the body 84 that includes a bend 125. Each contact arm 102 also extends along the central longitudinal axis 86 of the body 84 in a non-linear path. The bend 125 may have any angle. Moreover, the angular distance D of the offset may have any value. In some embodiments, the contact arms 102 include a chevron shape, as is shown in the exemplary embodiment. However, each contact arm 102 may include any other shape. Because the intermediate point 122 is offset along the circumference of the body 84 from the ends 118 and/or 120, a tangent to the intermediate point 122 extends non-parallel to a tangent to the ends 118 and/or 120 from which the intermediate point 122 is offset. In the exemplary embodiment, all of the contact arms 102 of the body 84 are shown herein as including the intermediate point 122 that is offset along the circumference of the body 84 from the ends 118 and/or 120. Alternatively, only some of the contact arms 102 may include any intermediate points 122 that are offset along the circumference of the body 84 from the ends 118 and/or 120.

In the exemplary embodiment, the intermediate point 122 is offset along the circumference of the body 84 from both ends 118 and 120. Alternatively, the intermediate point 122 of one or more of the contact arms 102 is offset along the circumference of the body 84 from only one of the ends 118 and 120. The contact tip 108 of the contact arms 102 include the intermediate point 122 in the exemplary embodiment. However, the intermediate point 122 of one or more of the contact arms 102 is optionally located at a different location along the length of the contact arm 102 than the contact tip 108. Moreover, although in the exemplary embodiment the intermediate point 122 is located approximately at a midpoint of the length of the contact arm 102, the intermediate point 122 of each contact arm 102 may be located at any other location along the length of the contact arm 102 than the midpoint. Similarly, the contact tip 108 of each contact arm 102 may be located at any other location along the length of the contact arm 102 than the midpoint. Referring again to FIG. 7, the contact tip 108 of each contact arm 102 optionally extends from the ends 118 and 120 (FIG. 6) radially inward relative to the central longitudinal axis 86 of the body 84. Each contact tip 108 may extend any distance radially inward relative to the central longitudinal axis 86.

Figure 8:
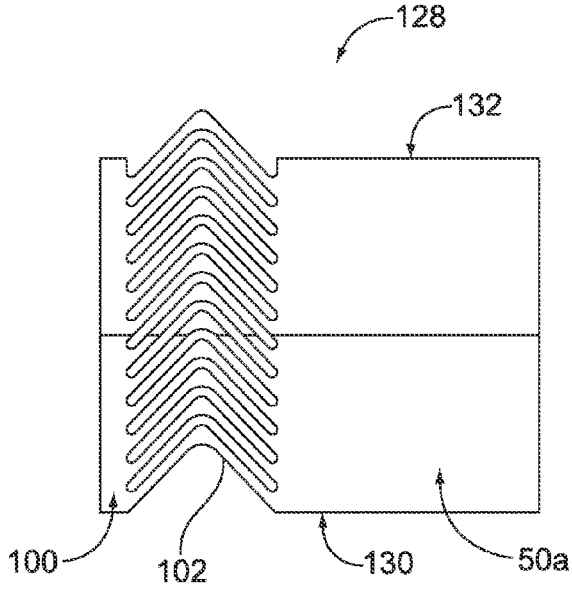
FIG. 8 is a plan view of an exemplary embodiment of a sheet of material that may be used to fabricate the electrical contact shown in FIGS. 6 and 7.

In some embodiments, the body 84 of the electrical contact 14*a* is stamped and/or cut from a sheet of material, although the body 84 may be fabricated using any other method, process, means, structure, and/or the like. For example, FIG. 8 is a plan view of an exemplary embodiment of a sheet of material 128 that may be used to fabricate the body 84 (FIGS. 6, 7, and 9) of the electrical contact 14*a* (FIGS. 1, 6, 7, and 9). The sheet of material 128 has been stamped and/or cut in pattern that forms the terminating segment 50*a*, the end segment 100, and the contact arms 102. As can be seen in FIG. 8, the contact arms 102 are nested within adjacent contact arms 102 and interconnect the terminating segment 50*a* and the end segment 100. To form the body 84, ends 130 and 132 of the sheet of material 128 are brought towards each other such that they oppose each other and thereby form the at least partially cylindrical body 84. Optionally, the ends 130 and 132 are engaged with each other and/or mechanically connected together.

FIG. 9 is a cross-sectional view of a portion of the electrical connector 10 illustrating the dielectric insert 16*a* retaining the electrical contact 14*a* within the housing 12. The base 60 of the dielectric insert 16*a* is received within the mounting cavity 42*a* of the housing base 20 such that the end 64 of the base 60 engages the bottom 46 of the mounting cavity 42*a*. Each latch tab 70 (FIGS. 3 and 4) of the dielectric insert 16*a* is received within the corresponding latch opening 52 (FIG. 2) of the mounting cavity 42*a* to hold the dielectric insert 16*a* within the mounting cavity 42*a*. The dielectric insert 16*a* is thereby held within the interior chamber 36 of the housing 12.

The electrical contact 14*a* is loaded into the contact channel 68 of the dielectric insert 16*a* in the direction of the arrow B. As the electrical contact 14*a* is loaded into the contact channel 68, the shoulder 98 of the sleeve 96 engages the resilient fingers 62 of the dielectric insert 16*a*. Engagement between the shoulder 98 and the resilient fingers 62 moves the tips 80 of the resilient fingers 62, against the bias thereof, radially outward relative to the central longitudinal axis 78 and toward the interior surface 76 of the base 60. The shoulder 98 thereby moves the tips 80 away from the locked position to enable the shoulder 98 to clear the tips 80. Once the shoulder 98 has passed the tips 80, the bias of the resilient fingers 62 moves the tips 80 back to the locked position, wherein the tips 80 engage the terminating segment 50*a* of the electrical contact 14*a*. Specifically, the end surfaces 82 of the tips 80 engage the shoulder 98 of the sleeve 96, while radially inner surfaces 95 of the tips 80 engage the sleeve 96 adjacent the shoulder 98. The resilient fingers 62 of the dielectric insert 16*a* thereby retain the electrical contact 14*a* within the interior chamber 36 of the housing 12. When retained in the interior chamber 36 of the housing 12, the terminating segment 50*a* of the electrical contact 14*a* extends within the contact channel 68 of the dielectric insert 16*a* and within the mounting cavity 42*a* of the housing base 20. The mating segment 40*a* of the electrical contact 14*a* extends through the opening 48 within the bottom 46 of the mating cavity 42*a* into the corresponding mating cavity 36*a* of the housing 12. The mating segment 40*a* of the electrical contact 14*a* thereby extends along the mating interface 30 of the housing 12.

To remove the electrical contact 14*a* from the interior chamber 36 of the housing 12, a tool (not shown) can be inserted into the contact channel 68 of the dielectric insert 16*a* within the space between the sleeve 96 and the interior surface 76 of the dielectric insert 16*a*. The tool engages the tips 80 of the resilient fingers 62 to move the tips 80, against the bias thereof, radially outward relative to the central longitudinal axis 78 and toward the interior surface 76. Once the tips 80 are moved radially outwardly past the shoulder 98 of the sleeve 96, the electrical contact 14*a* can be removed from the contact channel 68 of the dielectric insert 16*a* in the direction of the arrow C.

The dielectric inserts 16*b*, 16*c*, 16*d*, and 16*e* (FIG. 5) retain the corresponding electrical contacts 14 within the interior chamber 36 of the housing 12 in a substantially similar manner to the dielectric insert 16*a*, which therefore will not be described or illustrating in more detail herein. It should be understood, however, the corresponding electrical contacts 14 retained by the dielectric inserts 16*b*, 16*c*, 16*d*, and 16*e* may be different types of contacts from the electrical contact 14*a* and/or from each other. For example, one or more of the electrical contacts retained by the dielectric inserts 16*b*, 16*c*, 16*d*, and/or 16*e* may have a mating segment 40 that includes a receptacle (not shown) that receives a portion of the corresponding electrical contact (not shown) of the mating connector (not shown).

In addition or alternative to the dielectric insert 16 and/or the resilient finger 62, each electrical contact 14 may be held within the interior chamber 36 of the housing 12 using any other structure, method, means, and/or the like, such as, but not limited to, using a snap-fit, an interference (or clearance) fit, a retention clip (which may or may not include one or more fingers similar to the resilient fingers 62), an extension of the contact and/or another structure, an arm of the contact and/or another structure, a shoulder of the contact and/or another structure, a tab of the contact and/or another structure, other types of fasteners, and/or the like.

The embodiments described and/or illustrated herein may provide an electrical contact having longer contact arms than at least some known electrical contacts. The embodiments described and/or illustrated herein may provide an electrical contact having contact arms that grow less in length when engaged by a mating contact than at least some known electrical contacts. The embodiments described and/or illustrated herein may provide an electrical contact having contact arms that do not grow in length when engaged by a mating contact. The embodiments described and/or illustrated herein may provide an electrical contact having a lower insertion force than at least some known electrical contacts. The embodiments described and/or illustrated herein may provide an electrical contact having longer contact arms that extend a shorter distance along a length of the contact than at least some known electrical contacts. The embodiments described and/or illustrated herein may provide an electrical contact that can be fabricated by being stamped and/or cut out of a sheet of material. The embodiments described and/or illustrated herein may provide an electrical connector that is less expensive to fabricate and/or manufacture, wastes less material during fabrication, and/or takes less time to manufacture than at least some known electrical contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact comprising:

an at least partially cylindrical body comprising a terminating segment and an end segment, the terminating and end segments comprising cylinders that have approximately the same outer diameter as each other; and a contact arm extending from the terminating segment to the end segment, the contact arm comprising a contact tip configured to engage a mating contact to electrically connect the body to the mating contact, the contact arm defining a portion of a circumference of the body, wherein the contact arm extends from the terminating segment and the end segment at corresponding ends of the contact arm, the contact arm comprising an intermediate point that is located between the ends and that is offset from at least one of the ends along the circumference of the body, wherein the contact arm extends along a path about the circumference of the body and the path comprises a bend.

2. The contact according to claim 1, wherein the contact tip of the contact arm comprises the intermediate point.

3. The contact according to claim 1, wherein the body comprises a plurality of the contact arms spaced apart from one another about the circumference, the contact arms being nested within adjacent contact arms.

4. The contact according to claim 1, wherein the body extends a length along a central longitudinal axis, the contact arm extending from the ends radially inward relative to the central longitudinal axis.

5. The contact according to claim 1, wherein the contact arm comprises a chevron shape.

6. The contact according to claim 1, wherein the contact arm extends a length from the terminating segment to the end segment, the intermediate point of the contact arm being a midpoint of the length of the contact arm.

7. The contact according to claim 1, wherein the body extends a length along a central longitudinal axis, the terminating segment extending a greater length along the central longitudinal axis than the end segment.

8. The contact according to claim 1, wherein the terminating segment comprises an inner shell and a sleeve that extends at least partially around the inner shell, the inner shell comprises the cylinder of the terminating segment, and the sleeve does not extend around the contact arms.

9. The contact according to claim 1, wherein the terminating segment comprises an inner shell and a sleeve that extends at least partially around the inner shell, the inner shell comprises the cylinder of the terminating segment, the terminating segment extends fro the ends of the contacts arms to an opposite end of the terminating segment, and the sleeve comprises an open bottom such that the end of the terminating segment is open.

10. An electrical connector comprising:

a housing having a mating interface and an interior chamber;

an electrical contact held at least partially within the interior chamber of the housing, the electrical contact comprising:

an at least partially cylindrical body comprising a terminating segment and an end segment, the terminating segment comprising an inner shell and a sleeve that extends at least partially around the inner shell; and contact arms extending from the terminating segment to the end segment, the contact arms comprising contact tips configured to engage a mating contact to electrically connect the body to the mating contact, the contact arms defining a portion of a circumference of the body and being spaced apart from one another about the circumference, wherein the contact arms extend from the terminating segment and the end segment at corresponding ends of the contact arms, the contact arms comprising intermediate points that are located between the ends, wherein the intermediate point of at least one of the contact arms is offset along the circumference of the body in the same direction from both of the ends of the same contact arm, and wherein the terminating segment extends from the ends of the contacts arms to an opposite end of the terminating segment, the sleeve comprising an open bottom such that the end of the terminating segment is open.

11. The connector according to claim 10, wherein the contact arms extend along paths about the circumference of the body, the paths comprising bends.

12. The connector according to claim 10, wherein the tips change position about the circumference of the body when the contacts tips are deflected radially outwardly relative to a central longitudinal axis of the body.

13. The connector according to claim 10, wherein the contact tips of the contact arms comprise the intermediate points.

14. The connector according to claim 10, wherein the body of the electrical contact extends a length along a central longitudinal axis, the contact arms extending from the ends radially inward relative to the central longitudinal axis.

15. The connector according to claim 10, wherein the contact arms comprise chevron shapes.

16. The connector according to claim 10, wherein the contact arms extend lengths from the terminating segment to the end segment, the intermediate points of the contact arms being midpoints of the lengths of the contact arms.

17. The electrical connector according to claim 10, wherein the body of the electrical contact extends a length along a central longitudinal axis, the terminating segment extending a greater length along the central longitudinal axis than the end segment.

18. The electrical connector according to claim 10, wherein the terminating and end segments comprise cylinders that have approximately the same outer diameter as each other.

19. The electrical connector according to claim 10, wherein the sleeve does not extend around the contact arms.

20. An electrical contact comprising:

an at least partially cylindrical body comprising a terminating segment and an end segment, the body extending a length along a central longitudinal axis, the terminating and end segments comprising cylinders that have approximately the same outer diameter as each other; and a contact arm extending from the terminating segment to the end segment, the contact arm comprising a contact tip configured to engage a mating contact to electrically connect the body to the mating contact, the contact tip being configured to be deflected radially outwardly relative to the central longitudinal axis via engagement with the mating contact, wherein the contact arm does not grow in length as the contact tip is deflected radially outwardly relative to the central longitudinal axis.

* * * * *